US005304046A

United States Patent [19]

Yang

[11] Patent Number: 5,304,046

[45] Date of Patent: Apr. 19, 1994

[54] FLUID TRANSPORT DEVICE

[76] Inventor: Gene-Huang Yang, Suite 1, 11F, 95-8 Chang Ping Road, Sec. 1, Taichung Taiwan, Taiwan

[21] Appl. No.: 76,237

[22] Filed: Jun. 14, 1993

[51] Int. Cl.[5] ..... F04C 21/00

[52] U.S. Cl. ..... 417/519; 417/534

[58] Field of Search ..... 417/519, 532, 534, 538, 417/437

[56] References Cited

U.S. PATENT DOCUMENTS

| | | | |
|---|---|---|---|
| 3,871,793 | 3/1975 | Olson | 417/534 X |
| 4,410,299 | 10/1983 | Shimoyama | 417/519 X |
| 4,466,335 | 8/1984 | Milburn | 417/534 X |
| 4,679,994 | 7/1980 | Brown | 417/534 X |

*Primary Examiner*—Richard E. Gluck

[57] ABSTRACT

A fluid transport device for compressing or pumping a work fluid comprises a rotating coupling having an off-center first gear, a fixed internal second gear of twice the pitch diameter of the first gear, and a housing having a diametrical channel with a sliding piston disposed therein. A crank-like connector rotatably coupled with the first gear has a depending lug engaged within a hole in the piston and acts to drive the piston to and fro within the channel. First and second chambers are defined to either side of the piston, with the terminal ends of the chambers defined by the wall of the housing each having an egress aperture and an ingress chamber. A slotted depending rim of the coupling alternately obturates the egress aperture of one chamber and the ingress aperture of the other in step with the intake and expulsion stroke of the piston in each chamber.

6 Claims, 5 Drawing Sheets

FLUID TRANSPORT DEVICE

BACKGROUND OF THE PRESENT INVENTION

The present invention relates to a fluid transport device, and more particularly to a fluid transport device for compressing or pumping a work fluid and which is very suitable for refrigeration systems.

More conventional fluid displacement devices that are adaptable for use in refrigeration systems such as piston compressors or rotary compressors suffer from a number of deficiencies. In the case of the former, more complicated valve mechanisms are required along with inefficiencies in the use of space. While rotary compressors, such as the type characterized in having eccentric rotating cylinders have relatively lower compression and incur high rates of wear in their gating mechanisms. Yet other compressor types employing rotating scroll members through also achieving high compression and rotary efficiency, require very accurately dimensioned components that are difficult and expensive to manufacture.

Whereas, the fluid displacement device of the present invention achieves both high compression and the space efficiencies of a rotary type compressor system while still being inexpensive to manufacture. Further, the unique arrangement of the device enables a simplified and integral valve mechanism for controlling the intake and expulsion of work fluid.

SUMMARY OF THE PRESENT INVENTION

In accordance with the present invention, a fluid displacement device comprises a rotating coupling having a first gear eccentrically secured thereon, a stationery internal second gear engaged with the first gear and having twice the pitch diameter, and a housing defining a first and second chambers having a piston slidingly disposed therein. A crank-like connector rotatingly coupled to the first gear engages the piston therewith so that the piston is driven to and fro within the first and second chambers by the hypocycloidic rotation of the first gear. Each chamber has an egress aperture and an ingress aperture by which a work fluid is drawn into and expelled from the respective chambers.

It is a first object of the present invention to provide a fluid displacement device as characterized which offers improved performance and greater durability than more conventional devices while still maintaining structural simplicity and economy.

A further object of the present invention is to provide a fluid displacement device as characterized which offers improved performance and greater durability than more conventional devices while still maintaining structural simplicity and economy.

A further object of the present invention is to provide a fluid displacement device as characterized which incorporates a simplified valve means for directing the egress and ingress of the work fluid through either chamber of the device which is both reliable, compact and economical.

A more thorough understanding of the present invention will be attained by referring to a detailed description of a preferred embodiment thereof provided below, along with accompanying drawings.

DETAILED DESCRIPTION OF THE PREFERRED EMBODIMENT

Figure 1:
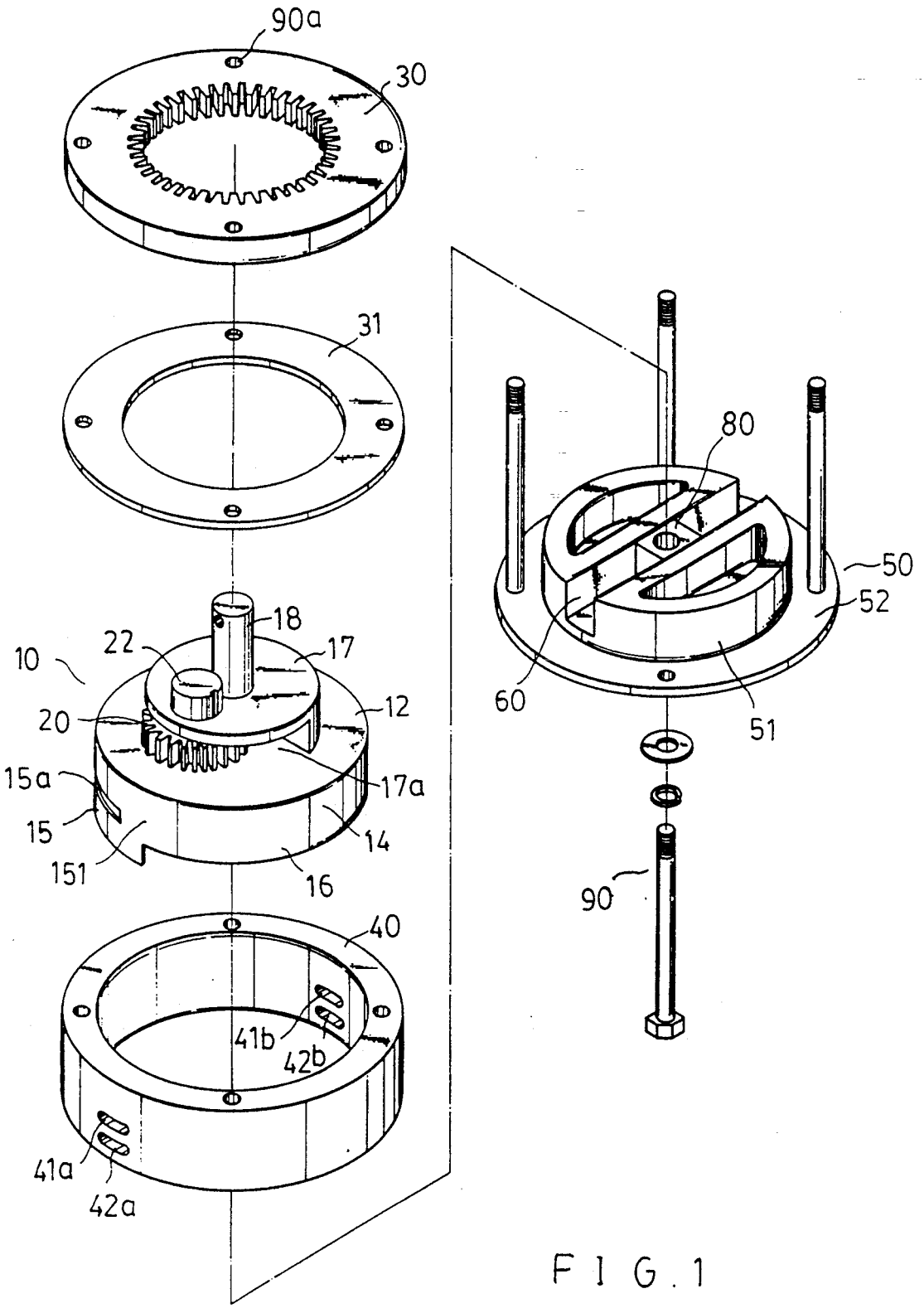
FIG. 1 is a perspective exploded view of the fluid transport device of the present invention.
Figure 2:
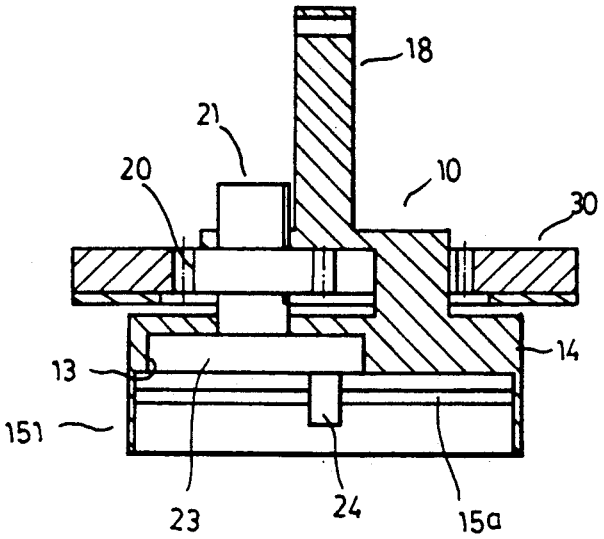
FIG. 2 is a side partly-sectional view showing the disposition of an inner gear and coupled link within a rotating coupler of the device.

Referring to FIGS. 1 and 2 of the drawings, the fluid transport device of the present invention comprises a rotating coupler 10 carrying an eccentric inner gear 20, an annular internally toothed outer gear 30 engaged with gear 20, a crank member 21 rotatingly coupled to gear 20 and having a depending lug 24, and a piston block 80 engaged with lug 24 slidingly disposed in a channel 60 defined in a housing of the device.

Coupler 10 of machined aluminum alloy has a lower generally cup shaped portion 12, an adjoining medial portion 17 of reduced diameter, and an upper shaft 18 for attachment with a drive source, such as an electric motor. The generally cylindrical medial portion 17 has a generally D-cavity 17*a* therein in which gear 20 extends. Crank member 21 has a keyed shaft 22 which is engaged with gear 20 and is rotatingly disposed through an aperture on the medial portion above cavity 17*a*. The gear 20 is offset from the rotational axis of coupler 10 by half of the pitch diameter thereof.

The crank member 21 also of machined aluminum alloy has a circular base 23 below the gear 20. A cylindrical lug 24 depends from a peripheral portion of base 23 with the axis of lug 24 being parallel with the rotational axis of gear 20 and tangent with the pitch circle thereof. A stepped diameter aperture 13 is formed eccentrically in the circular land of cup-shaped portion 13 with base 23 being disposed in the larger diameter lower section thereof and shaft 22 extending through the smaller diameter section.

Outer gear 30 of a synthetic plastic compound is secured over the housing and has a pitch diameter twice that of gear 20 which is parallel engaged therewith and of a similar material. Thus when torque is applied to shaft 18, gear 20 carried by rotating coupler 10 revolves in a hypocycloidic fashion within gear 30. Concomitantly, lug 24 moves linearly to and fro across a diameter of gear 30.

The periphery of the cup-shaped portion 12 has a stepped lower rim 14 having a first circumferential sector 15 and a second circumferential sector 16. Sector 15 which extends further downward than sector 16 has an angular span slightly greater than 180 degrees. A circumferential slot 15*a* is formed along a predetermined position on sector 15 higher than the lower rim of sector 16. A pair of cut-off spaces 151 of predetermined angular span are defined between the terminal edges of sector 15 and the respective ends of slot 15*a*. In this embodiment, the centerlines of the respective cut-off spaces are aligned diametrically and also intersect the rotational axis of gear 20.

The steel housing comprises a peripheral member 40 having the form of a cylindrical annulus, and an inner member 50 having a circular base 52 of the same diameter as member 40 and a cylindrical boss 51 of diameter slightly less than that of the inner periphery of member 40. An annular groove is thus defined between the outer periphery of boss 51 and the inner periphery of member 40. Member 50 is secured to member 40 with the lower face thereof in abutment with base 52. A recessed channel 60 is formed diametrically across boss 51 with a rectangular piston block 80 being slidingly disposed therein. An annular flange 31 disposed between gear 30 and member 40 is in abutment over a peripheral portion of coupler 10. A set of through holes 90*a* extends through gear 30, flange 31 and the housing members. A set of elongate fasteners 90 pass through holes 90*a* to secure the assembly together.

Figure 3:
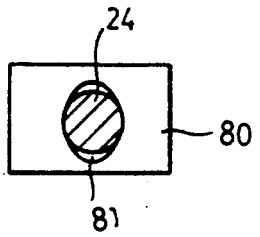
FIG. 3 is a schematic view showing the exaggerated ovoid section of an axle hole in a piston of the device.

The circular inner side of cup-shaped portion 12 is in sealing abutment against the top surfaces of boss 51 as is the lower side of base 23, wherein rim 14 extends into the groove defined between the boss and the peripheral member. Lug 24 is engaged within an axle hole 81 in piston block 80, wherein gear 20 is positioned perpendicularly with respect to channel 60 when the block is at a central position therein. As shown in FIG. 3, the axle hole 81 has an ovoid section with a major axis extending in a perpendicular direction with respect to the slide direction of the piston block. This arrangement is more forgiving of dimensional tolerances in the drive mechanism and reduces friction and wear. The piston block is thus driven to and fro within channel 60 by the action of lug 24.

A pair of slot like egress apertures 41*a*, 41*b* are formed at diametrically opposed positions on the peripheral member 40 in alignment and communication with channel 60. A further pair of similarly shaped ingress apertures 42*a*, 42*b* are formed below the respective apertures 41*a*, 41*b*.

It should be noted that terminology such as above and below found in the hereabove disclosure is applied only for reason of clarity and conciseness of description with respect to the accompanying drawings, and does not imply any necessary or preferred gravitational orientation of the device.

In operation, first and second chambers are defined within the channel between respective sides of the piston block 80 and the inner wall of cup-shaped portion 12. Wherein, the to and fro motion of the piston block within the channel alternately expels a work fluid from one chamber through an associated egress aperture while bringing in work fluid into the other chamber via an associated ingress aperture.

Figure 4:
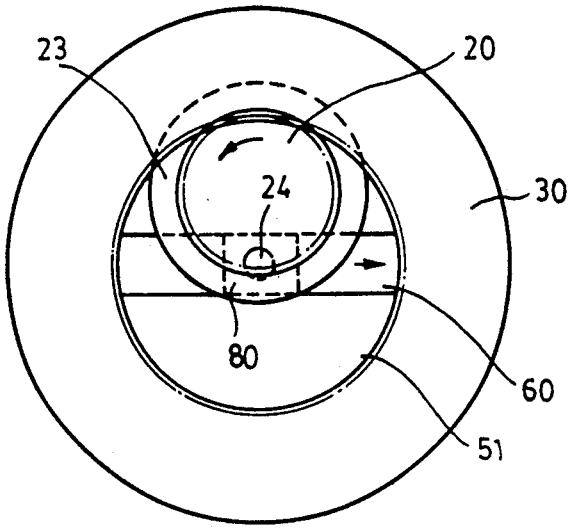
FIG. 4 is a top view of the device with the upper portions of the coupler cut-away so as to show the inner gear at a first position with respect to a lower channel whereat the piston slidingly disposed in the channel is at a central position therein.
Figure 5:
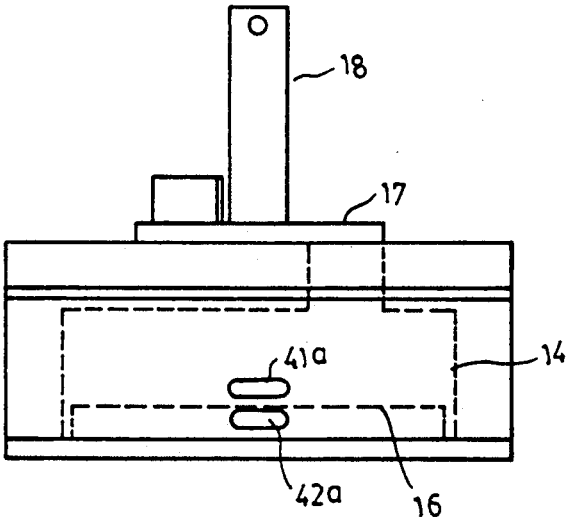
FIG. 5 is a side view showing an integral valve means on the coupler when at a position corresponding with that of FIG. 4, whereat lower ingress apertures on either end of the channel are open while adjacent upper egress aperture are obturated.

Referring to FIGS. 4 and 5, when the clockwise rotating coupler 10 is in a first rotary position, whereat gear 20 is at a perpendicular orientation with respect to the channel 60, block 80 is at a central position therein and moving to the right so as to expel work fluid from the egress aperture of the corresponding chamber. The stepped lower rim 14 of cup-shaped portion 12 acts as a valve member to control the opening and obturation of the respective egress and ingress apertures on either side of the channel. As shown in FIG. 5, the chamber defined to the left of the piston block is drawing in work fluid via the associated lower ingress aperture 42*a* which is not obturated by the lesser height sector 16 of the rim presently spanning the corresponding apertures of the left chamber. The associated upper egress aperture 41*a*, however, is obturated by sector 16 so as to prevent backflow of work fluid into the left chamber. Concomitantly, the egress and ingress apertures of the right chamber are respectively open and obturated so as to enable the expulsion of work fluid from the chamber through the proper conduit.

Figure 6:
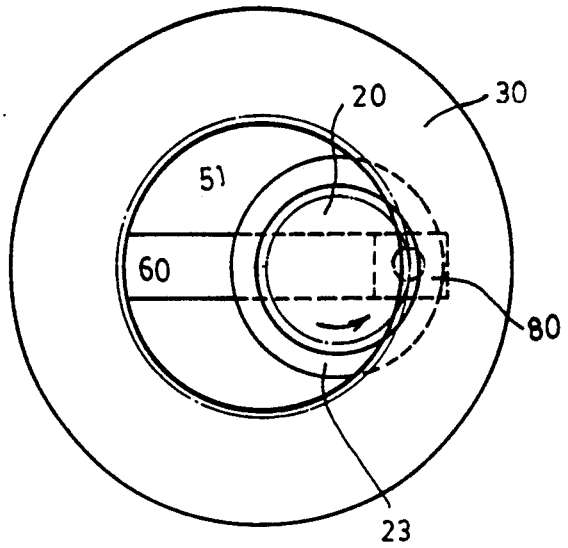
FIG. 6 is a top view, as in FIG. 4, showing the inner gear and engaged piston at a second position with respect to the channel.
Figure 7:
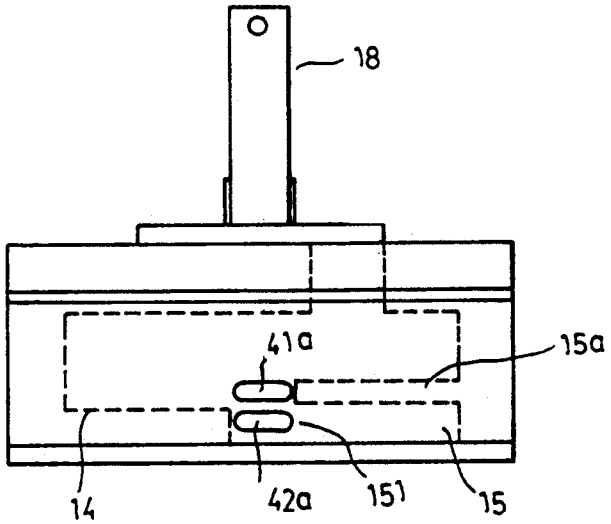
FIG. 7 is a side view, as in FIG. 5, showing the corresponding position of the valve means when the coupler is at the second position, whereat both the egress and ingress apertures are obturated.

As shown in FIGS. 6 and 7, all apertures are obturated when the gear 20 is revolved into alignment with the channel, wherein cut-off spaces 151 of sector 15 prevent the ingress or egress of work fluid into either chamber. At this second position, wherein the coupler has rotated 90 degrees from the first position, the piston block is at the end of its travel in the right chamber and commences to accelerate into the left chamber.

Figure 8:
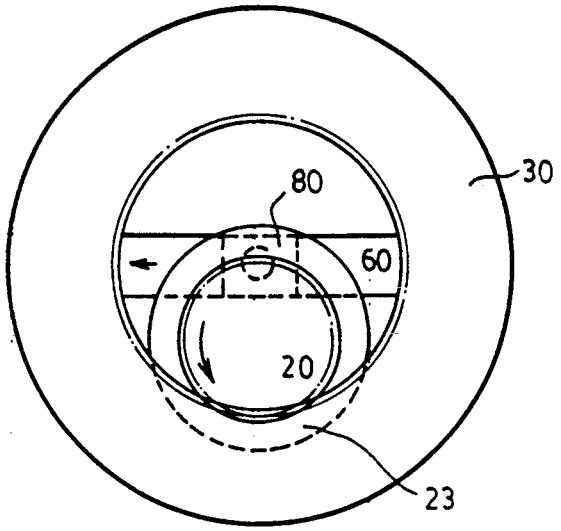
FIG. 8 is yet another top view showing the inner gear and piston when the coupler is at a third position.
Figure 9:
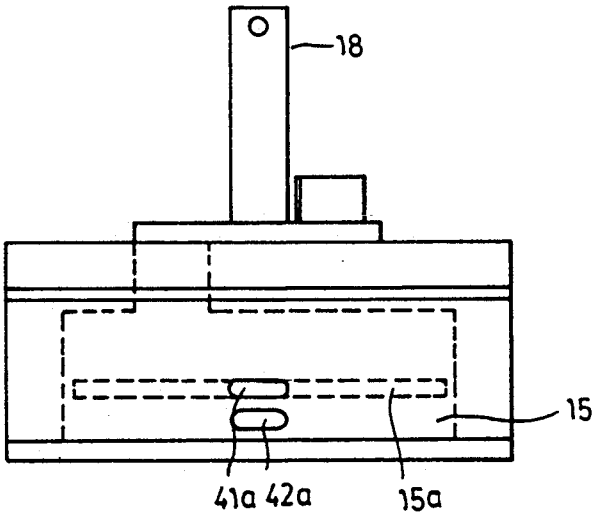
FIG. 9 is a side view showing the corresponding position of the valve means when the coupler is at the third position, whereat the lower ingress apertures are obturated while the upper egress aperture is open.

FIG. 8 shows the position of gear 20 and block 80 after the coupler rotates clockwise by a further 90 degrees to a third position, whereat the piston block is once again at the central position in channel 60 but moving to the left and expelling work fluid from the left chamber. As shown in FIG. 9, egress aperture 41*a* of the left chamber is now in registry with slot 15*a* on sector 15 so as to allow the outward flow of work fluid while the lower ingress aperture 42*a* is obturated by the lower portions of sector 15 below the slot. Apertures 41*b*, 42*b* of the right chamber which is now drawing in work fluid are respectively obturated and open by sector 14 in position thereover.

Thus each chamber alternately executes an intake and expulsion stroke upon each rotation of coupler 10. Note further that in comparison with the single chamber per piston arrangement in more conventional reciprocating piston devices, the piston block 80 defines dual chambers with both intake and expulsion occurring upon each stroke.

Though many specificities were brought forth in the above description, these should not be construed in a limitative sense in relation to the present invention but rather as being exemplary thereof. Many modifications and variations could be readily accomplished by a person of average skill in the art. For example, the specific materials employed in the various members along with their particular arrangements could be easily adapted to suit varying needs. More significantly, the angular dispositions of the various sectors and slots on the rotating valve member in relation to the integral coupler, along with their angular spaces, can all be modified to suit the requirements of various systems. As such, the spirit and scope of the present invention should be determined not from above disclosure, but rather from the appended claims and their legal equivalents.

I claim:

1. A fluid transport device for compressing or pumping a work fluid comprising;

a rotatingly supported coupling defining a first rotational axis:

a first gear of predetermined pitch diameter rotatingly secured to said coupling, the rotational axis of said first gear being parallel with said first rotational axis and offset therefrom by half the pitch diameter of said first gear;

a stationery internal second gear parallel engaged with said first gear and having a pitch diameter twice that of said first gear;

a housing means defining aligned first and second chambers;

a piston means slidingly engaged in said first and second chambers;

a connecting means for engaging said piston means with said first gear, said connecting means defining a second rotational axis parallel with the rotational axis of said first gear and tangent to the pitch circle thereof, whereby the rotation of said coupling about said first rotational axis effects a to and fro sliding motion of said piston means in said first chamber and said second chamber;

a driver means for delivering torque to said coupling means;

at least one aperture in communication with said first chamber and at least one aperture in communication with said second chamber, for the passage of said working fluid;

a valve means for directing an egress of said working fluid from said first chamber or said second cylinder via a corresponding said at least one aperture to an outlet conduit and directing an ingress of said working fluid into said first chamber or said second chamber via a corresponding said at least one aperture from an inlet conduit.

2. A fluid transport device according to claim 1, wherein:

said first chamber and said second chamber each have a first said at least one aperture for the egress of said work fluid therefrom, and a second said at least one aperture for the ingress of said work fluid;

said valve means includes a rotating member integrally coupled to said coupler and having obturating surfaces thereon for alternatingly obturating the first said at least one aperture of said first chamber and leaving open the second said at least one aperture thereof while leaving open the first said at least one aperture of said second chamber and obturating the second said at least one aperture thereof, and then leaving open the first said at least one aperture of said first chamber and obturating the second said at least one aperture thereof while obturating the first said at least one aperture of said second chamber and leaving open the second said at least one aperture thereof, during each rotation of said coupler.

3. A fluid transport device according to claim 2, wherein said connecting means comprises a crank member having a circular base disposed to one side of said first gear and a shaft extending therethrough and rotatingly coupled therewith, said circular base having a projecting lug on a periphery thereof engaging said piston means and defining said second rotational axis.

4. A fluid transport device according to claim 3, wherein:

said projecting lug has a cylindrical form; and said piston means has a recessed axle hole for receiving said projecting lug, said axle hole having a generally ovoid section with a major axis extending in a direction perpendicular to the direction of travel of said piston means.

5. A fluid transport device according to claim 4, wherein said housing means includes:

a peripheral member of annular cylindrical form having the first and second said at least one aperture of said first chamber and the first and second said at least one aperture of said second chamber formed thereon at diametrically opposed positions;

a central member of generally cylindrical form disposed concentrically within said peripheral member wherein an annular space is defined therebetween, said central member having a recessed channel formed diametrically thereacross with said piston means being slidingly disposed therein, defining said first chamber and said second chamber to either side thereof.

6. A fluid transport device according to claim 5, wherein:

the first said at least one apertures of said first chamber and said second chamber and the second said at least one apertures of said first chamber and said second chamber are disposed along a generally parallel direction with respect to the cylindrical axis of said peripheral member;

said obturating surfaces of said valve means are defined by an annular rim member extending into the annular space between said peripheral member and said central member, said rim member having a first circumferential sector of predetermined angular span and a second circumferential sector of predetermined angular span having a lesser height than the first circumferential sector, with the first circumferential sector having greater angular span than the second circumferential sector, a circumferential slot of predetermined angular span is formed at a predetermined angular position and height around the first circumferential sector defining stop surfaces between the terminal edges of the first circumferential sector and respective ends of the circumferential slot.

* * * * *